US005577627A

United States Patent [19]

Richie-Dubler

[11] Patent Number: 5,577,627

[45] Date of Patent: Nov. 26, 1996

[54] HINGE STRUCTURE FOR THERMOFORMED PLASTIC CONTAINERS

[75] Inventor: Susan J. Richie-Dubler, Canandaigua, N.Y.

[73] Assignee: Tenneco Packaging, Evanston, Ill.

[21] Appl. No.: 478,123

[22] Filed: Jun. 7, 1995

[51] Int. Cl.[6] ..... B65D 43/16

[52] U.S. Cl. ..... 220/4.23; 220/339

[58] Field of Search ..... 220/339, 337, 220/4.23; 215/235

[56] References Cited

U.S. PATENT DOCUMENTS

| | | | |
|---|---|---|---|
| 3,900,550 | 8/1975 | Oliver et al. | 220/339 |
| 4,403,712 | 9/1983 | Wiesinger | 220/339 |
| 4,703,853 | 11/1987 | Byrns | 220/339 X |
| 4,901,884 | 2/1990 | Kallenbach | 220/4.23 X |
| 5,046,659 | 9/1991 | Warburton | 220/4.23 X |
| 5,115,931 | 5/1992 | Dubach | 220/339 X |
| 5,131,551 | 7/1992 | Wells | 220/4.23 |
| 5,242,696 | 9/1993 | McDevitt | 426/106 |
| 5,269,430 | 12/1993 | Schlaupitz et al. | 220/4.23 |
| 5,405,009 | 4/1995 | Hackenbracht | 220/339 X |
| 5,437,383 | 8/1995 | Stull | 220/339 X |

FOREIGN PATENT DOCUMENTS

| | | | |
|---|---|---|---|
| 563781 | 10/1993 | European Pat. Off. | 220/339 |

*Primary Examiner*—Allan N. Shoap
*Assistant Examiner*—Nathan Newhouse
*Attorney, Agent, or Firm*—Arnold, White & Durkee

[57] ABSTRACT

An integral multi-section hinge structure for a thermoplastic container including creased hinge sections at the extremities of the hinge and at least one intermediate formed hinge.

13 Claims, 6 Drawing Sheets

HINGE STRUCTURE FOR THERMOFORMED PLASTIC CONTAINERS

BACKGROUND OF THE INVENTION

The present invention relates to improvements in thermoformed plastic containers for food or other articles and particularly to the hinge structure for securing the lid and base of the container together.

Containers for food or other articles thermoformed from plastic material normally comprise a lid and base which are hinged to each other. Such containers are normally thermoformed from a sheet of thermoplastic material by forming in the plastic sheet a base and lid joined to each other by an integral hinge area and forming a crease longitudinally of the hinge area to permit the lid to be folded relative to the base. An example of such prior art container is disclosed in U.S. Pat. No. 5,046,659. This type of hinge is referred to in the art as a full length creased or scored hinge. One of the disadvantages with a hinge of this type is that the lid and base can be easily separated with any torsional pressure. A second type of hinge used in the prior art is known as a full length formed hinge which is usually quite stiff and causes the container to gap open at the ends which can lead to product contamination.

It would be desirable to provide an improved integral hinge structure for a thermoformed plastic container which combines the desirable characteristics of the creased hinge and formed hinge, namely, the tight fit and the torsional strength, while eliminating the undesirable characteristics, namely, the lack of torsional strength and the stiffness of the hinge which causes the container to gap open and leads to product contamination.

SUMMARY OF THE INVENTION

It is an object of the present invention to overcome the difficulties of the prior art in providing a hinge structure for a container which is substantially non-breakable and resistant to torsional pressure thereby preventing the lid to be separated from the base while enabling the lid and hinge of the container to tightly close.

In accordance with the present invention there is provided a thermoformed plastic container comprising a base and a lid hinged thereto wherein the hinge comprises a foldable area of plastic extending along adjacent sides of the base and the lid and integral therewith. The foldable area has a fold line extending longitudinally of the foldable area and dividing the lid from the base. The fold line at the extremities thereof has creased hinge sections in the foldable area. The foldable area has at least one intermediate formed hinge area along with a corresponding intermediate section of the fold line. The intermediate formed hinge area includes a cavity having tapered ends and a substantially V-shaped cross section along the bottom of which extends the intermediate section of the fold line. The cavity has a central portion connecting the tapered ends. The fold line of the tapered ends form an acute angle with respect to the fold line of the creased hinge section and the V-shaped cross section has an included acute angle.

In accordance with another aspect of the invention there is provided a method of thermoforming a hinged plastic container from a sheet of thermoplastic material comprising the steps of forming in the plastic sheet a base and lid joined to each other by an integral hinge area. A crease is formed longitudinally of the hinge area to permit the lid to be folded relative to the base along a fold line. Intermediate the ends of the crease in the hinge area there is formed a V-shaped cavity having tapered ends that lie along the longitudinal axis of the crease along with the bottom of the V-shaped cavity.

For further objects and advantages of the present invention, reference may be had to the following description and claims and from the accompanying drawing.

DETAILED DESCRIPTION OF THE PREFERRED EMBODIMENT

Figure 1:
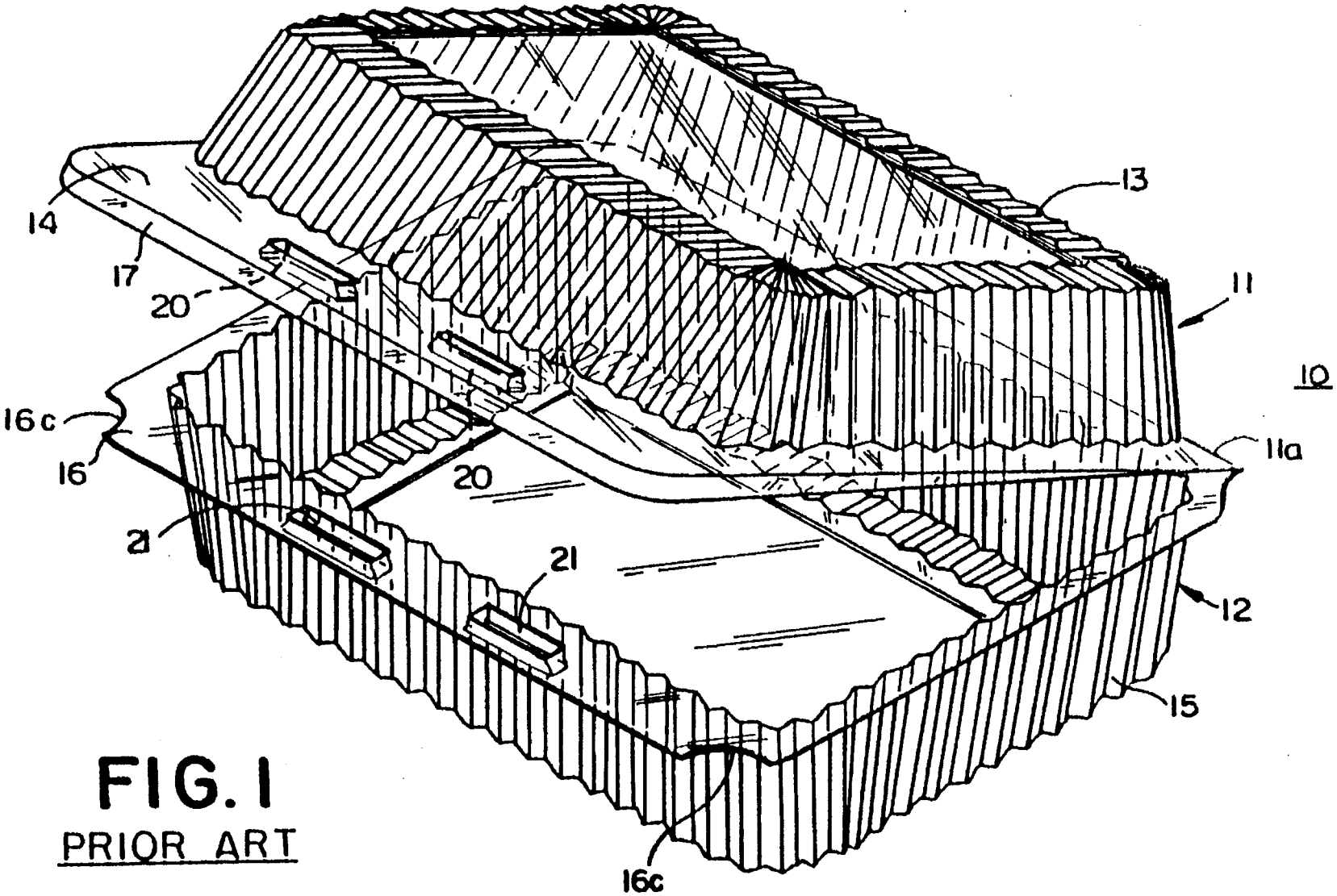
FIG. 1 PRIOR ART
FIG. 1 is a perspective view of a prior art container for food or other articles showing a lid hinged to a base utilizing a full length scored hinge of the prior art type.

Referring to the drawings, there is shown in FIG. 1 a prior art plastic container 10 of the type illustrated in the aforesaid U.S. Pat. No. 5,046,659. The purpose of FIG. 1 is to illustrate one of the numerous types of plastic containers to which the improved hinge structure of the present invention may be applied. The container 10 is designed to be thermoformed from a suitable plastic material. One clear plastic material which is particularly suited is oriented polystyrene (O.P.S). Other thermoformed plastic materials may be used depending upon the end use of the containers. The plastic materials however should be capable of being thermoformed. The container 10 is particularly adapted for food or other articles and includes a lid 11 hinged at the rear 11*a* to a base 12. The hinge 11*a* is known in the art as a full length creased or scored hinge. Hinges of this type have the disadvantage that the lid and base can be easily separated with any torsional pressure. The lid 11 includes a central dome portion 13 having a horizontal flange 14 extending around the periphery thereof. The base 12 includes a central receptacle portion 15 having a horizontal flange 16 extending around the periphery thereof. The flange 14 on the lid 11 is provided with a depending rim 17 at the front of the lid opposite the hinge 11*a*. The rim 17 tapers from a maximum vertical dimension along the front end of the lid to a minimum along the sides as it approaches the hinge 11*a*. The horizontal flange 14 on the lid 11 is adapted for engagement with the horizontal flange 16 on the base 12 when the container 10 is in closed condition. The base flange 16 preferably is provided with cut-outs 16*c* at the corners adjacent the latching structures 20–21 to aid in opening the container. Further details of the construction of container 10 are described and illustrated in U.S. Pat. No. 5,046,659 but do not form part of the present invention.

Figure 2:
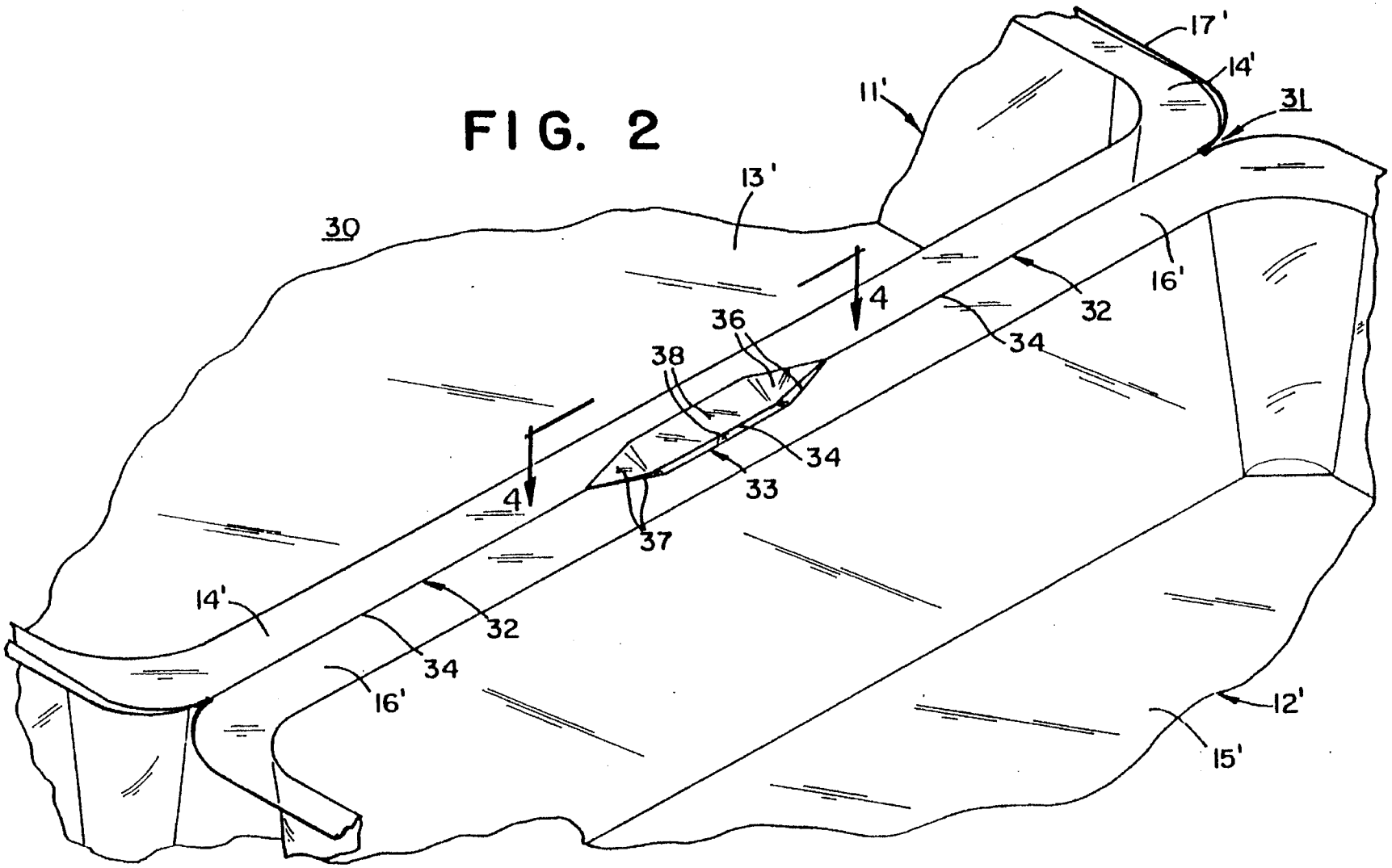
FIG. 2 is a fractional perspective view of a container utilizing the improved hinge of the present invention and showing the Container and hinge in an open condition.

Referring to FIG. 2 there is illustrated a fractional view of a thermoformed plastic container 30 embodying an improved integral multi-section hinge 31 of the present invention. The container 30 shown in FIG. 2 is similar to the prior art container 10 shown in FIG. 1 with the exception of the new integral multi-section hinge 31 and corresponding parts of container 30 will be identified with corresponding reference characters with the addition of a prime. Also the flutes or ribs illustrated in FIG. 1 have been omitted in FIG. 2 for purposes of clarity. It will of course be understood that the present hinge structure is applicable to containers whether the sidewalls have ribs or not. The new integral multi-section hinge structure 31 of the present invention comprises a creased hinge section 32 at the extremities of the hinge and at least one intermediate formed hinge 33. As may be seen in FIG. 2 the thermoformed plastic container 30 comprises a base 12' and a lid 13' hinged thereto. The multi-section hinge 31 comprises a foldable area of plastic extending along adjacent sides of the base 12' and lid 13' and integral therewith. This foldable area extends longitudinally of the horizontal flanges 14', 16' and includes a fold line 34 extending longitudinally of the foldable area and dividing the lid 11' from the base 12'. The fold line 34 at the extremities thereof includes the creased hinge sections 32, 32 in the foldable area. The foldable area also has at least one intermediate formed hinge 33 along with a corresponding intermediate section of the fold line 34.

Figure 4:
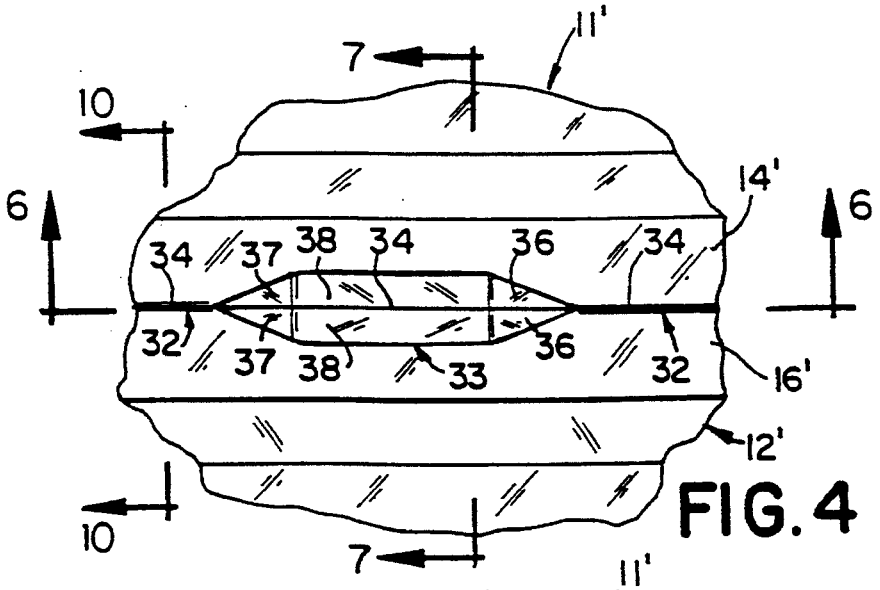
FIG. 4 is a plan view of the open hinge taken along the lines 4—4 in FIG. 2.
Figure 5:
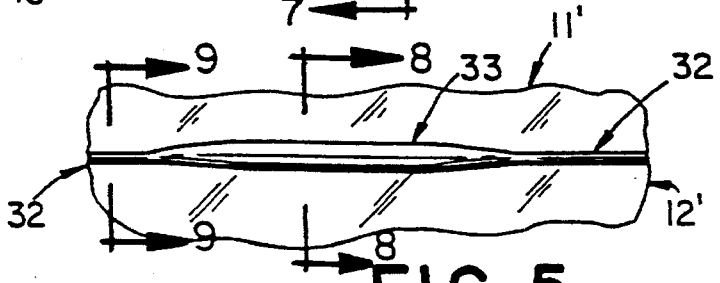
FIG. 5 is a side elevational view of the closed hinge taken along the lines 5—5 in FIG. 3.
Figure 7:
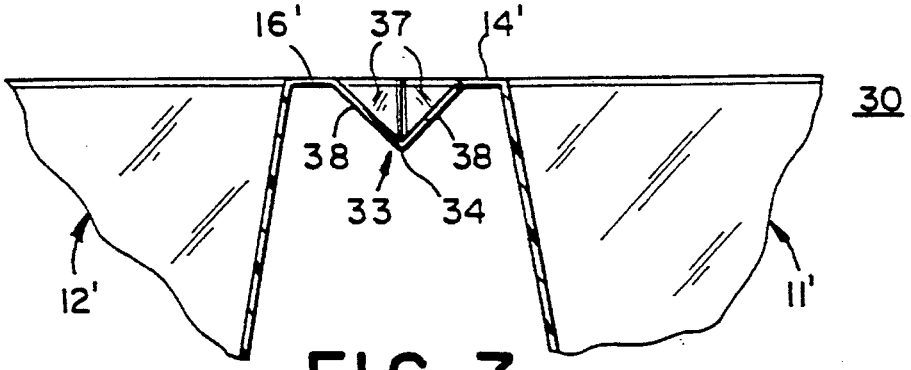
FIG. 7 is an enlarged cross sectional view of the open formed hinge section taken along the lines 7—7 in FIG. 4.
Figure 8:
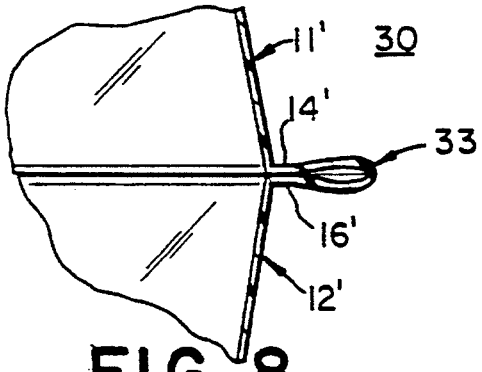
FIG. 8 is an enlarged vertical sectional view of the closed formed hinge section taken along the lines 8—8 in FIG. 5.
Figure 9:
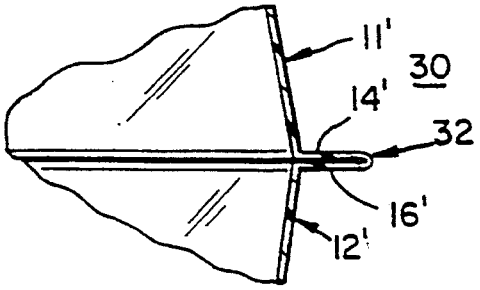
FIG. 9 is an enlarged vertical sectional view of the closed creased hinge section taken along the lines 9—9 in FIG. 5.

As may be seen in FIG. 2 the intermediate formed hinge 33 is shaped like a boat having tapered ends at the opposite ends thereof and the corresponding intermediate section of the fold line 34 runs longitudinally of the boat shaped formed hinge 33 similar to the keel of a boat. As may be seen in FIGS. 2 and 4 the intermediate formed hinge 33 is a cavity having tapered ends 36 and 37 which are identical in configuration and are connected by a central portion 38. The cavity has a substantially V-shaped cross-section along the bottom of which extends the intermediate section of the fold line 34. As may be seen in FIGS. 2 and 4 the cavity has a length greater than the width thereof. The tapered ends of the cavity are formed respectively by a pair of triangular walls or panels 36, 36 and 37, 37. The central portion of the cavity is formed by a pair of rectangular walls or panels 38, 38 which form a V-shaped cross section and have an included acute angle therebetween. The transverse cross-section of the central portion 38, 38 of the cavity showing the acute angle is best seen in FIG. 7. By way of example, in one embodiment the acute angle of the V-shaped cross section was about 80°. It will be understood that this angle could vary in size. It should be less than 90° and preferably between about 70° and about 85°.

Figure 6:
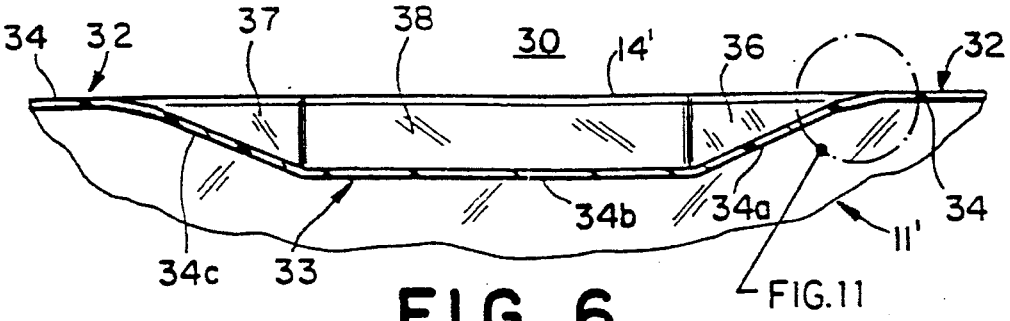
FIG. 6 is a fractional vertical sectional view on enlarged scale of the open hinge taken along the lines 6—6 in FIG. 4.

The longitudinal cross-section of the cavity of the intermediate formed hinge 33 is best shown in FIG. 6. The corresponding intermediate section of the fold line 34 extending longitudinally of the formed hinge area 33 comprises three segments 34*a*, 34*b* and 34*c*. The segment 34*a* is associated with the triangular panels 36 and the segment 34*c* is associated with the triangular panels 37. Each of the fold line segments 34*a* and 34*c* forms an acute angle A with respect to the horizontal fold line 34 of the creased hinge section 32 which extends along the top of the horizontal flange 14'. These angles are the same since, as pointed out above, the tapered ends of the cavity are identical in configuration. The segment 34*b* of the fold line, which extends along the bottom of the central portion of the cavity formed by the pair of rectangular panels 38, 38, is parallel to the horizontal flange 14' and the fold line 34 of the creased hinge sections 32. It will be seen in FIG. 6 that the segments 34*a* and 34*c* of the fold line 34 form an included obtuse angle with the segment 34*b* of the fold line.

Figure 3:
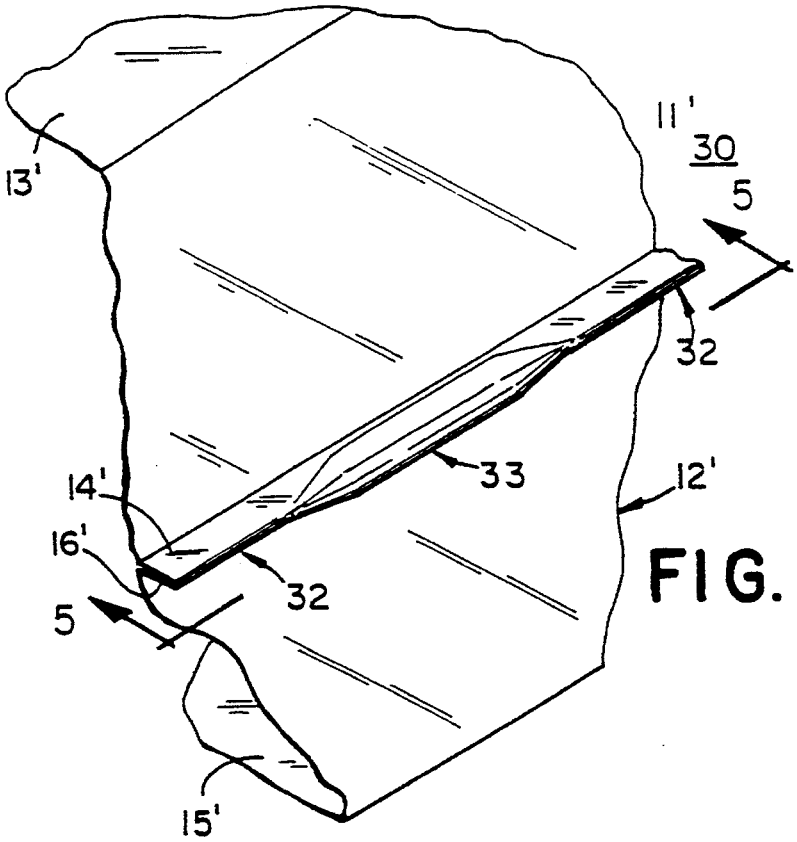
FIG. 3 is a fractional perspective view of the improved hinge of FIG. 2 showing the container and hinge in a closed condition taken from the rear of the container.
Figure 10:
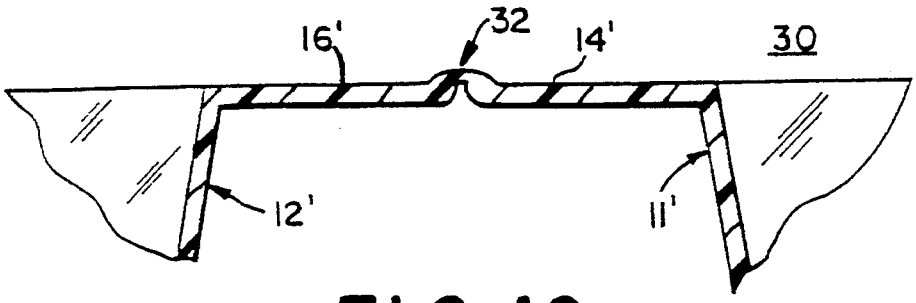
FIG. 10 is an enlarged cross sectional view of the open creased hinge taken along the lines 10—10 in FIG. 4.
Figure 11:
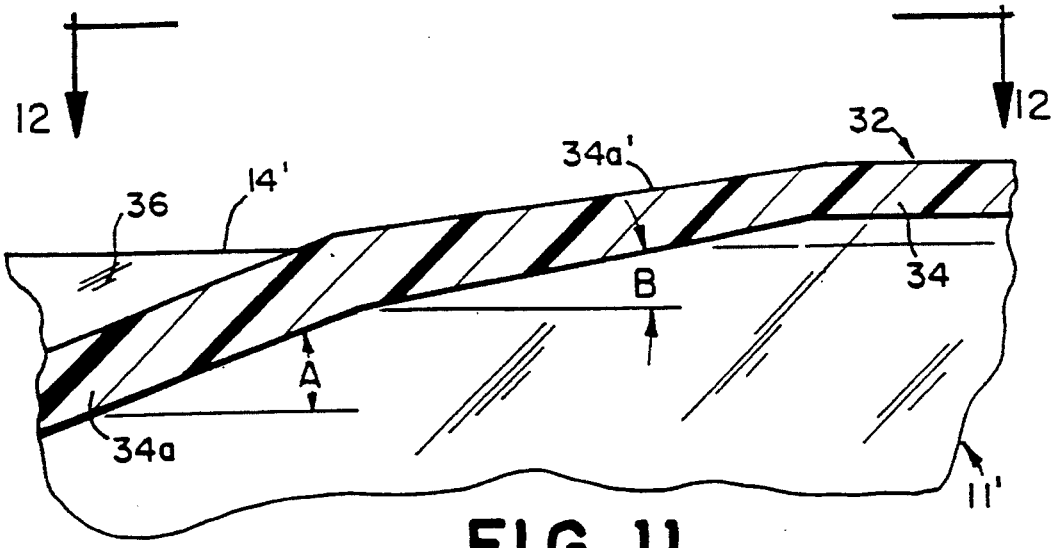
FIG. 11 is a greatly enlarged area in FIG. 6.
Figure 12:
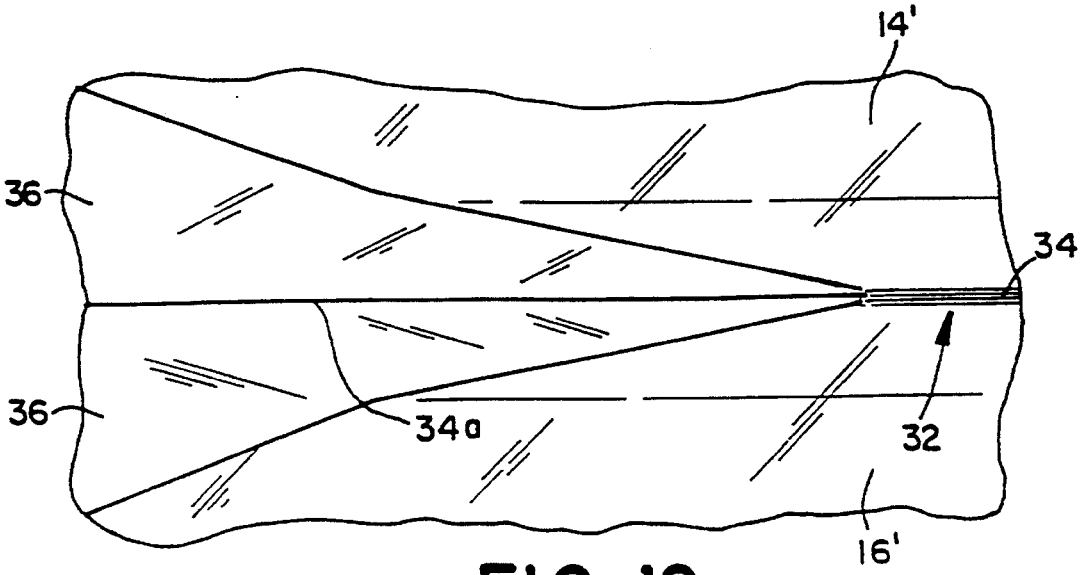
FIG. 12 is a plan view of the area in FIG. 11.

When the container 30 is closed, the lid 11' is rotated around the hinge fold line 34 to bring the flange 14' of the lid into contact with the flange 16' on the base. This is best shown in FIGS. 3, 5, 8 and 9. It will be noted in FIG. 9 that the formed hinge 33 extends outwardly from the container 30 a greater distance than the creased hinge 32. This is also seen in FIG. 3. When the lid 11' on the container 30 is moved to the closed position, the plastic creases along the fold line 34 of the multi-section hinge 31. This is readily accomplished along the fold line of the creased hinges 32 since the cross sectional width of those hinges is relatively small. This is best seen in FIG. 10. To aid in forcing the tapered ends of the formed hinge 33 to crease the plastic material along the fold line 34, the crease of the hinge 32 extends into the end of the V in the formed hinge 33. To better illustrate this, the right hand end of the formed hinge 33 as shown in FIG. 6 is illustrated on enlarged scale in FIGS. 11 and 12. As pointed out above the fold line segment 34*a* makes a predetermined acute angle A with respect to the horizontal fold line 34 of the creased hinge section 32 which extends along the top of the horizontal flange 14'. At the extreme tip end of the tapered portions 36 of the hinge 33 the fold line 34*a'* is inclined at a smaller acute angle B with respect to the horizontal to merge at its extreme end with the fold line 34 of the hinge 32. Angle B is a transition angle of the fold line 34' from the formed hinge 33 to the creased hinge 32. Thus there is formed a complex angle comprising angles A and B. By way of example in one embodiment of the invention the fold line 34*a* throughout most of its length formed an acute angle A of approximately 20° with the horizontal. At the upper end 34*a'* of the fold line 34*a* the transaction angle B was about 11° with the horizontal. It is to be understood that this is an example of a preferred embodiment. It will be understood that the acute angle A could extend for the full length of the fold line 34*a* if desired. It is also to be understood that the acute angle A could vary in size to a maximum of about 45° and a minimum of about 15° . It is also to be understood that the acute angle B can vary either larger or smaller than angle A. While FIGS. 11 and 12 have been described and illustrated with respect to the right hand end of FIG. 6, it is to be understood that the same description applies to the fold line 34*c* at the opposite end of FIG. 6 since both ends of the hinge 33 are identical in configuration.

Figure 13:
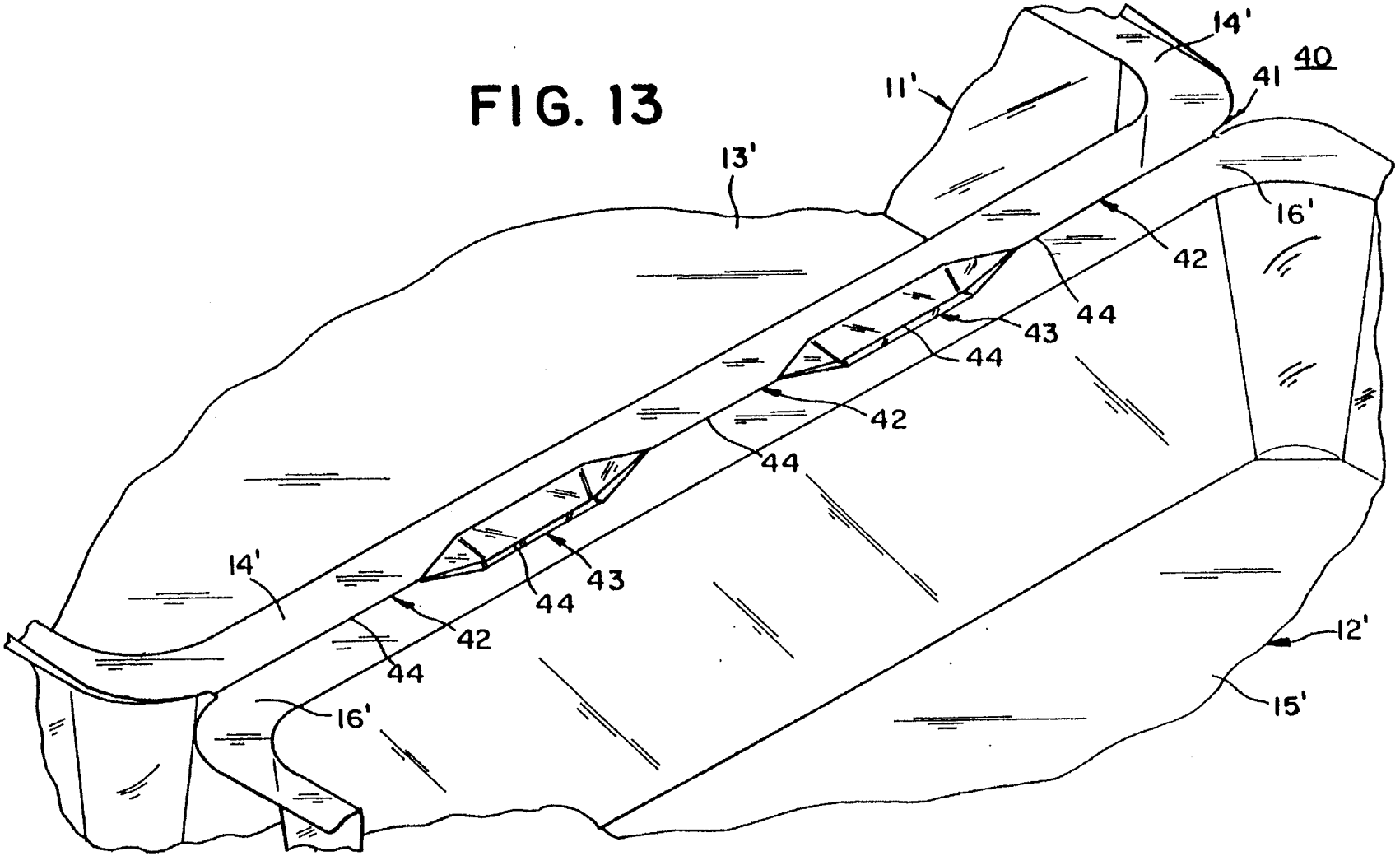
FIG. 13 is a perspective view similar to FIG. 2 but showing a modification with a plurality of formed hinge sections.

Referring to FIG. 13 there is illustrated a fractional perspective view of another thermoplastic container 40 similar to container 30 except it is provided with a new integral multi-section hinge structure 41 comprising three creased hinge sections 42 separated by two intermediate formed hinges 43. In this embodiment it will be noted that the formed hinge areas 43, 43 are separated by a creased hinge section 42. The fold line is indicated at 44. The formed hinges 43 are identical in construction to the formed hinge 33 previously described and illustrated in connection with FIGS. 2–12. The other parts of the container 40 are identified with similar reference characters. Thus it is not believed necessary to repeat the description for the formed hinge 43.

The technique for molding thermoformed plastic containers such for example as the prior art container illustrated in FIG. 1 is well known in the art. In molding containers of this type, a sheet of plastic material to be thermoformed is placed on a hot platen. A mold having the configuration of the container to be formed is placed above the plastic sheet. The hot platen softens the plastic sheet and air is forced up through the hot platen against the lower surface of the softened sheet of plastic. This causes the plastic to move upwardly against the inner surface of the mold and assume the configuration of the mold cavity. In molding the hinge of the present invention the hinge dies are positioned between the mold cavities for the lid and base of the container along the hinge line of the container to be formed. The dies for creating the creased hinges are referred to in the art as crease knives. The crease knives have a V-shaped configuration and form the indentation in the plastic of the creased hinge 32 as illustrated in FIG. 10. In one example, the crease knives had an included angle in the V of approximately 60° . The plastic sheet material to be formed had a thickness of about 0.015". The height of the V-shaped knife was about 0.026" and it was adapted to penetrate the plastic film to a depth of about 0.006". The die for molding the formed hinge 33 had a die cavity corresponding to the shape of the formed hinge 33 as shown in FIG. 7. In this example the V-shaped cross-section of the formed hinge 33 had an included angle of about 80° and a depth of approximately 0.20". The tapered ends of the formed hinge were formed by correspondingly shaped cavities in the die that were inclined at an angle of about 20° with respect to the horizontal with the extreme ends being tapered at a transition angle of about 11°. The overall length of the cavity in the die for forming the hinge 33 in this example was about 2.5". The overall length of the die forming the central portion of the cavity between the two tapered ends was about 1.5".

From the foregoing it will be seen that in each embodiment of the invention the integral multi-section hinges comprise creased hinge sections at the extremities of the fold line of the hinge and at least one intermediate formed hinge along a corresponding intermediate section of the fold line. While the creased hinges at the extremities of the fold line may break with repeated folding of the hinge, nevertheless the lid will not be separated from the base of the container because of the intermediate formed hinge which is substantially indestructible. The creased hinges at the extremities of the fold line enable the lid to close tightly against the base thus preventing the container from gaping open at the ends of the hinge which can lead to product contamination. Even if the creased hinges break during opening and closing of the container, this still does not prevent the container lid from closing tightly against the base. By locating the formed hinge intermediate the ends of the fold line, the formed hinge is sufficiently displaced from the ends of the hinge so as to avoid causing the container to gap open and lead to product contamination. The use of more than one formed hinge along the fold line as shown in FIG. 13 provides further assurance against the separation of the lid from the base during opening and closing of the container without substantial increase in the stiffness of the hinge structure which causes the container to gap open and leads to product contamination.

While there has been described a preferred embodiment of the invention, it will be understood that further modifications may be made without departing from the spirit and scope of the invention as set forth in the appended claims.

What is claimed is:

1. A thermoplastic container comprising:

a base and a lid hinged thereto wherein said hinge comprises a foldable area of plastic extending along adjacent sides of said base and said lid and integral therewith, said foldable area having a fold line extending longitudinally of said foldable area and dividing said lid from said base, said fold line having at the extremities thereof creased hinge sections in said foldable area, and said foldable area having at least one intermediate formed hinge, wherein said intermediate formed hinge includes a cavity having tapered ends and a central portion having two generally parallel sections connecting said tapered ends, said cavity having a substantially V-shaped cross-section along a bottom of which extends an intermediate section of said fold line, said cavity having a length greater than the width thereof.

2. A thermoformed plastic container according to claim 1 wherein said intermediate formed hinge extends outwardly from the container along with said corresponding intermediate section of said fold line.

3. A thermoformed plastic container according to claim 1 wherein said foldable area includes a plurality of intermediate formed hinges each separated by a creased hinge section on said fold line.

4. A thermoformed plastic container according to claim 1 wherein the fold line of said tapered ends forms an acute angle with respect to the fold line of the creased hinge section and wherein said V-shaped cross section has an included acute angle.

5. A thermoformed plastic container according to claim 4 wherein said acute angle formed by the fold line of the tapered end with the fold line of the creased hinge section is a complex angle varying from a larger acute angle at one end of the fold line to a smaller acute angle at the other end of the fold line.

6. A thermoformed plastic container according to claim 4 wherein said acute angle formed by the fold line of the tapered end with the fold line of the creased hinge section is a complex angle varying from about 20° at the bottom of the cavity to about 11° at the top of the cavity.

7. A thermoformed plastic container according to claim 4 wherein said acute angle formed by the fold line of the tapered end with the fold line of the creased hinged section is within the range of about 45° to 15° .

8. A thermoformed plastic container according to claim 4 wherein said included acute angle of said V-shaped cross-section is between about 70° and 85°.

9. A thermoformed plastic container according to claim 1 wherein said intermediate section of said fold line comprises three segments co-extensive respectively with the lengths of said tapered ends and said central portion of said cavity.

10. A thermoformed plastic container according to claim 9 wherein said fold line of said central portion of said cavity of said intermediate section and said fold lines of said creased hinges on the opposite sides of said intermediate section are parallel to each other.

11. A thermoformed plastic container according to claim 10 wherein each of said segments of said fold line of said tapered ends form an obtuse angle with said fold line of said central portion.

12. A method of thermoforming a hinged plastic container from a sheet of thermoplastic material comprising the steps of:

forming in the plastic sheet a base and a lid joined to each other by an integral hinge area, forming a crease longitudinally of the hinge area to permit the lid to be folded relative to the base along a fold line, and intermediate the ends of the crease in the hinge area forming a formed hinge having a cavity with tapered ends and a central portion having two generally parallel sections connecting said tapered ends, said cavity having a substantially V-shaped cross-section along a bottom of which extends an intermediate section of said fold line, said cavity having a length greater than the width thereof.

13. A method of thermoforming a hinged plastic container according to claim 12 wherein the bottom of the V-shaped cavity extends to one side of the longitudinal axis.

* * * * *